US006964063B2

(12) United States Patent
Bamber

(10) Patent No.: US 6,964,063 B2
(45) Date of Patent: Nov. 15, 2005

(54) SPORTS GLOVE

(76) Inventor: Jeffrey V. Bamber, 5023 Village Dr., Cincinnati, OH (US) 45244

( * ) Notice: Subject to any disclaimer, the term of this patent is extended or adjusted under 35 U.S.C. 154(b) by 0 days.

(21) Appl. No.: 10/672,138

(22) Filed: Sep. 26, 2003

(65) Prior Publication Data

US 2004/0060097 A1 Apr. 1, 2004

Related U.S. Application Data

(60) Provisional application No. 60/414,715, filed on Sep. 28, 2002.

(51) Int. Cl.[7] ..... A41D 19/00
(52) U.S. Cl. ..... 2/161.1
(58) Field of Search ..... 2/16, 20, 159, 2/160, 161.1, 161.2, 161.4; 24/452, 442, 24/450

(56) References Cited

U.S. PATENT DOCUMENTS

| | | | |
|---|---|---|---|
| 2,858,542 | A | 11/1958 | Ogg |
| 3,277,547 | A | 10/1966 | Billarant |
| 3,372,401 | A | 3/1968 | Woodward |
| 3,490,107 | A | 1/1970 | Brumlik |
| 3,494,006 | A | 2/1970 | Brumlik |
| 3,588,917 | A | 6/1971 | Antonious |
| 3,649,967 | A | 3/1972 | Millman |
| 3,665,921 | A | 5/1972 | Stumpf |
| 3,694,867 | A | 10/1972 | Stumpf |
| 3,708,833 | A | 1/1973 | Ribich et al. |
| 4,040,126 | A | 8/1977 | Cecil |
| 4,042,977 | A | 8/1977 | Antonious |
| 4,051,553 | A | 10/1977 | Howard |
| 4,374,888 | A | 2/1983 | Bornslaeger |
| 4,379,192 | A | 4/1983 | Wahlquist et al. |
| 4,418,123 | A | 11/1983 | Bunnelle et al. |
| RE31,538 | E | 3/1984 | Antonious |
| 4,489,444 | A | 12/1984 | Graham |
| 4,600,618 | A | 7/1986 | Raychok, Jr. et al. |
| 4,639,947 | A | 2/1987 | Lanscioni |
| 4,648,876 | A | 3/1987 | Becker et al. |
| 4,701,963 | A | 10/1987 | Overton |
| D293,850 | S | 1/1988 | Dzierson, Jr. |
| 4,725,473 | A | 2/1988 | Van Gompel et al. |
| 4,761,318 | A | 8/1988 | Ott et al. |
| 4,761,322 | A | 8/1988 | Raley |

(Continued)

FOREIGN PATENT DOCUMENTS

| | | |
|---|---|---|
| EP | 0 482 873 A1 | 4/1992 |

OTHER PUBLICATIONS

U.S. Appl. No. 10/948,860, filed Sep. 24, 2004, Bamber.

(Continued)

*Primary Examiner*—Gary L. Welch
(74) *Attorney, Agent, or Firm*—Hasse & Nesbitt LLC; Donald E. Hasse

(57) ABSTRACT

A sports glove, such as a golf glove, baseball batting glove, or other type of glove is disclosed. In one non-limiting embodiment, the sports glove has a fastener made of a breathable material. In another embodiment, the sports glove has a fastener with apertures therein. In another embodiment, the sports glove has a container joined thereto that can be used for storing the glove after use. In another embodiment, the sports glove is provided with one or more regions comprising extensible material. In another embodiment, the sports glove is provided with an extensible fastener. In some embodiments, any portion of the glove, such as the fingers and/or the palm and back of the glove, may be provided in a pre-formed curved configuration.

16 Claims, 8 Drawing Sheets

U.S. PATENT DOCUMENTS 4,776,068 A 10/1988 Smirlock et al.
4,843,651 A 7/1989 Gramza et al.
4,891,258 A 1/1990 Fahrenkrug
4,943,340 A 7/1990 Ujimoto et al.
4,973,326 A 11/1990 Wood et al.
5,032,122 A 7/1991 Noel et al.
5,043,036 A 8/1991 Swenson
5,058,247 A 10/1991 Thomas et al.
5,116,563 A 5/1992 Thomas et al.
5,180,534 A 1/1993 Thomas et al.
5,184,353 A 2/1993 Goldwitz
5,195,188 A 3/1993 Bourdeau et al.
5,221,276 A 6/1993 Battrell
5,230,851 A 7/1993 Thomas
D340,793 S 11/1993 Autier
5,300,058 A 4/1994 Goulait et al.
5,308,345 A 5/1994 Herrin
5,318,741 A 6/1994 Thomas
5,325,569 A 7/1994 Goulait et al.
5,326,415 A 7/1994 Thomas et al.
5,326,612 A 7/1994 Goulait
5,354,591 A 10/1994 Ott et al.
5,373,712 A * 12/1994 Yamamoto et al. ..... 66/195
5,383,871 A 1/1995 Carlin et al.
5,385,706 A 1/1995 Thomas
5,390,372 A 2/1995 Hashimoto et al.
5,392,498 A 2/1995 Goulait et al.
5,447,590 A 9/1995 Gilpatrick
5,451,219 A 9/1995 Suzuki et al.
5,476,702 A 12/1995 Datta et al.
5,528,773 A 6/1996 Lowinger
5,540,673 A 7/1996 Thomas et al.
5,554,239 A 9/1996 Datta et al.
5,636,414 A 6/1997 Litchholt
5,704,065 A * 1/1998 Feuerhake ..... 2/161.2
5,708,979 A 1/1998 Redwood et al.
5,730,739 A 3/1998 Lavash et al.
5,762,645 A 6/1998 Peck et al.
5,797,170 A * 8/1998 Akeno ..... 24/452
5,855,022 A 1/1999 Storto
5,893,172 A 4/1999 Haynes et al.
5,933,867 A 8/1999 Corder
5,997,981 A 12/1999 McCormack et al.
6,059,764 A 5/2000 Osborn, III et al.
D426,922 S 6/2000 Redwood et al.
6,154,885 A 12/2000 Kobayashi et al.
6,260,288 B1 * 7/2001 Barthelemy et al. ..... 36/3 R
6,277,104 B1 8/2001 Lasko et al.
6,405,380 B1 6/2002 Kuroda et al.
6,415,445 B1 7/2002 Nishijima et al.
6,427,247 B1 8/2002 Suk
D462,810 S 9/2002 Knight
D464,178 S 10/2002 Redwood et al.
6,505,350 B2 1/2003 Litke
6,513,165 B1 2/2003 England et al.
6,513,166 B1 2/2003 Landis
6,519,776 B1 2/2003 Davenport et al.
D471,674 S 3/2003 Redwood et al.
6,539,549 B1 4/2003 Peters, Jr.
6,543,058 B2 4/2003 Litke
6,546,599 B2 4/2003 Pelt et al.
6,553,575 B1 4/2003 Davenport et al.
6,625,815 B2 9/2003 Litke
6,694,576 B1 * 2/2004 Fujisawa et al. ..... 24/452
6,732,377 B1 5/2004 Wilkinson
6,745,402 B2 6/2004 Caswell
2003/0167553 A1 9/2003 Caswell et al.

OTHER PUBLICATIONS

Author Unknown, FOOTJOY® STA-SOF® golf glove advertisement, GOLF Magazine, Mar., 1992, pp. 48-49, vol. 34, No. 3, Times Mirror Magazines, NY, NY, U.S.A.

Author Unknown, Quicklon, YKK (Thailand) Co., Ltd. Website, Feb. 7 and 20, 2005, YKK (Thailand) Co., Bangkok, Thailand. (Believed to be assignee of U.S. Patent 5373,712 issued to Yamamoto, et al. Date these pages were first published on website is unknown. Employee data, however, on website is given as of 1996.).

Author Unknown, Elastic Loop Tapes (describing VELSTRETCH® Brand Loop 151 and VELCRO® Brand Loop 152), Velcro USA Inc. Product Information Guide, Mar., 2002, Velcro U.S.A. Inc., Manchester, NH, U.S.A.

Rick Johnson, From Tee to Green, Natural Golf Pro Performance Player's glove, Natural Golfer Magazine, Sep./Oct. 2002, p. 28,vol. 4, Issue 5, Natural Golfer Magazine, Mt. Prospect, IL, U.S.A.

Author Unknown, Natural Golf Gloves—Practice Glove, Natural Golf Pro Performance Player's glove, Natural Golfer Magazine, Sep./Oct. 2002, p. 59,vol. 4, Issue 5, Natural Golfer Magazine, Mt. Prospect, IL, U.S.A.

Author Unknown, Gloves—Gold Ribbon Values (including NIKE Tech Feel glove, NIKE Dri-FIT Tour glove, FOOTJOY F3 glove, LYNX Performa glove, LYNX Tour Premium glove, and CALLAWAY Pro Series glove), Golfsmith Catalog, Holiday, 2002, p. 30, Golfsmith International, Inc., Austin, TX, U.S.A.

Author Unknown, MIZUNO Double Strap Glove, The Cincinnati Enquirer newspaper, Golf Galaxy advertisement, Sports section p. C3, Apr. 11, 2003, The Cincinnati Enquirer, Cincinnati, OH, U.S.A.

E. Michael Johnson, Equipment, Golf World Magazine, Jun. 27, 2003, p. 12, vol. 57, No. 2, The Golf Digest Companies, Trumbull, CT, U.S.A.

Eileen R. Broderick and Tom Dellner, Techno Chic, LINKS Magazine (including MIZUNO Tech-Fit glove, MAXFLI Noodle glove, NIKE Elite Feel glove, FOOTJOY SciFlex glove, WILSON ProFit glove, and ETONIC Stabilizer Pro glove), Jan./Feb. 2004, pp. 90-92, vol. 17, No. 1, Purcell Enterprises, Inc., Hilton Head Island, SC, U.S.A.

Author Unknown, Aquity Accufit Glove, The Cincinnati Enquirer newspaper, Dick's Sporting Goods insert, p. 5, Jan. 11, 2004, The Cincinnati Enquirer, Cincinnati, OH, U.S.A.

Author Unknown, Grandoe Ski Gloves, www.grandoe.com, Jan. 11, 2004, GRANDOE, Gloversville, NY, U.S.A.

* cited by examiner

SPORTS GLOVE

CROSS-REFERENCE TO RELATED APPLICATIONS

This application claims the benefit of the filing date of U.S. Provisional Patent application Ser. No. 60/414,715, filed on Sep. 28, 2002, which is incorporated by reference herein.

FIELD OF THE INVENTION

The present invention relates to a sports glove, such as a golf glove, football player's glove, baseball batting glove, or other type of glove.

BACKGROUND OF THE INVENTION

Sports gloves, such as a golf gloves, football players' gloves, baseball batting gloves, or other types of gloves are commonly made of leather, as well as some other materials. These types of gloves will frequently have a fastener made of VELCRO® material on the portion of the glove that covers the back of the wearer's hand.

There are several disadvantages associated with such gloves. One disadvantage is that the VELCRO material fastener, when fastened, will provide a structure that is two or more layers thick. The two or more layers may comprise the two layers of VELCRO® material that are fastened together, along with the layers of the glove to which they are attached. This can cause the glove to hold heat from the back of the wearer's hand, which is especially a problem on hot days. When a glove is worn on a hot day, it will tend to be soaked with sweat, particularly at a location on the back of the wearer's hand. After a glove has been soaked, it will often become stiff in the regions that were wet. A glove with stiff regions is less comfortable and does not fit as well as a glove that has been dry.

Another disadvantage of such gloves is that after a period of several uses, the glove becomes baggy and less closely-fitting, particularly at the region of the back of the wearer's knuckles. In addition, the portions of the glove that are elasticated (such as those portions worn adjacent to the wearer's wrist, and other portions that are typically positioned to be worn adjacent to the back of the wearer's hand) can suffer from the disadvantage that the elastic ceases to function as intended. In addition, the bagginess and loss of close fit can cause the VELCRO® fastening material to lose its ability to adjust when closing so that the glove becomes too loose even when the fastener is pulled closed as tightly as possible.

Thus, there is a need to provide sports gloves with improved features.

SUMMARY OF THE INVENTION

The present invention relates to a sports glove, such as a golf glove, football player's glove, baseball batting glove, or other type of glove. Certain features of the sports glove described herein may also comprise inventions in their own right and can be used on articles other than sports gloves.

There are numerous, non-limiting embodiments of the invention. All embodiments, even if they are only described as being "embodiments" of the invention, are intended to be non-limiting (that is, there may be other embodiments in addition to these), unless they are expressly described as limiting the scope of the invention. Any of the embodiments described herein can also be combined with any other embodiments to form still other embodiments.

In one non-limiting embodiment, the sports glove has a fastener made of a breathable material. In another embodiment, the fastener on the sports glove has apertures therein. In another embodiment, the sports glove has a container joined thereto that can be used for storing the glove after use. In another embodiment, the sports glove is provided with one or more regions comprising extensible material. The extensible material can be retractable. For instance, the extensible material can be elastically retractable by virtue of being attached to the body of the glove when the material is in a stretched condition. In another embodiment, the sports glove is provided with an extensible fastener. In other embodiments, the sports glove may be provided with one or more fasteners that can either adjust, or be adjusted to tighten the closure of the glove.

In any of the embodiments in which the glove is provided with apertures, the apertures may be configured with a shape that is one-directional (e.g., funnel-shaped) to transport moisture away from the wearer's skin. In these or other embodiments, the glove may be provided with one or more vents in key places, or other desirable places. In these or other embodiments, the glove may be provided with a substance, or one or more elements, on the inner surface of the glove to space portions of the wearer's hand away from the glove material. Other embodiments are also contemplated.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE INVENTION

The present invention relates to a sports glove, such as a golf glove, football player's glove, baseball batting glove, or other type of glove.

Figure 1:
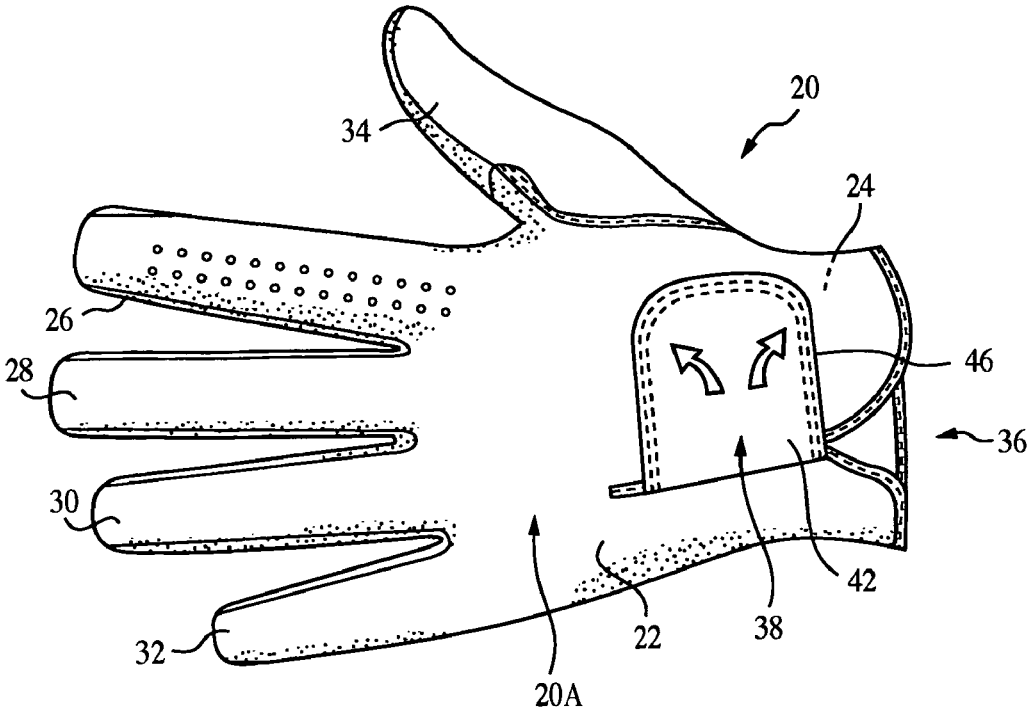
FIG. 1 is a rear view of a sports glove having a fastener made of a breathable material.

FIG. 1 shows one non-limiting embodiment of a sports glove 20. The sports glove 20 comprises a body portion 20A; a back portion 22 that fits adjacent the back of the wearer's hand; a front portion 24 that fits adjacent the wearer's palm; four finger portions 26, 28, 30, and 32; a thumb portion 34; and a V-shaped cut-out 36 in the back portion 22 that provides the ability to adjust a fastener 38.

Figure 2:
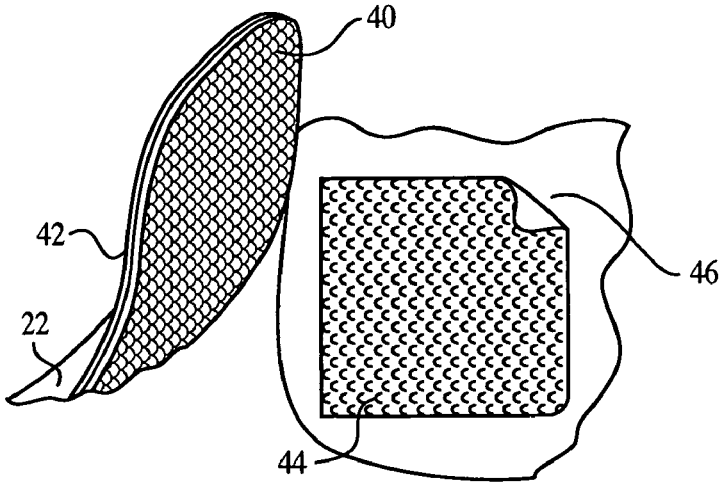
FIG. 2 is a perspective view of the portions of a sports glove having a fastener thereon.

The fastener 38 can comprise any suitable type of fastener. In one embodiment, the fastener 38 comprises a hook and loop material, such as VELCRO® fastening material. VELCRO® fastening material typically comprises a substrate material that has a plurality of small hook elements joined thereto, and a complementary material comprising a substrate having a plurality of small loops of material joined thereto. As shown in FIG. 2, the loop material 40 is typically fastened to an extension 42 of the back 22 of the glove. The loop material 40 mates with a complementary hook material 44 that is attached to an underlying portion 46 on the back of the glove. Although only a portion of the loop material 40 and hook material 44 is shown, it is understood that any suitable portion of the substrates, including the entire surfaces thereof, may be covered with the loop material and the hook material, respectively.

In the embodiment shown in FIG. 1, the sports glove 20 has a fastener 38 which is made from a breathable material. The term "breathable" refers to a material that is pervious to air and moisture. In other less preferred embodiments, the fastener 38 may only be pervious to air or moisture. The unnumbered arrows in FIG. 1 show that moisture can pass through the fastener 38, away from the back of the wearer's hand. In one embodiment, the substrate for the hook and loop material can be made of a breathable material, which may include, but is not limited to GORTEX® material or COOLMAX® material available from DuPont.

Figure 3:
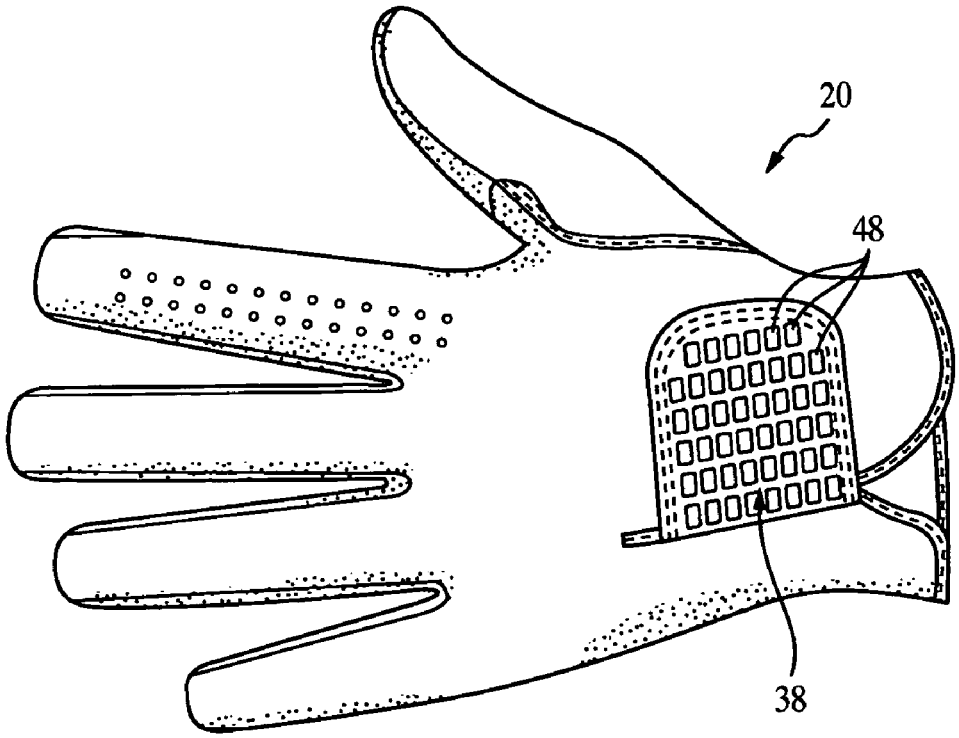
FIG. 3 is a rear view of a sports glove having a fastener with apertures therein.

FIG. 3 shows an embodiment of a sports glove 20 in which the fastener 38 is apertured. This can reduce the build-up of heat in the region of the back of the wearer's hand. There can be any number of apertures 48. The apertures 48 can be of any size and shape. It may be desirable for the apertures 48 to have a shape that provides for a passageway through all the layers of the fastener and the glove regardless of the degree to which the components of the fastener 38 are overlapped to close the same. It may, therefore, be desirable for some of the apertures 48 to be longer in one direction than in the other direction. In one non-limiting embodiment, at least some of the apertures 48 may be oblong.

Figure 4:
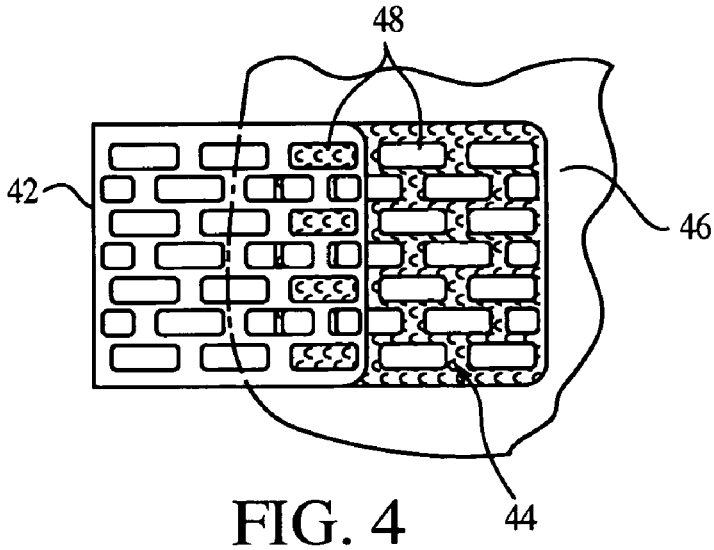
FIG. 4 is a top view of the fastener of a sports glove and a portion of the glove to which it is attached.

FIG. 4 shows one non-limiting embodiment of how the portions of the glove and fastener 38 can be configured to provide apertures 48 that can align to provide a passageway through all the layers. It is understood that all or any portion of the fastener can comprise such apertures 38, and that these apertures 48 can be provided over substantially the entire portions of the components of the fastener 38. The apertures 48 can have rounded portions, such as at the ends thereof, to resist tearing when the fastener 38 is opened and closed.

Figure 5:
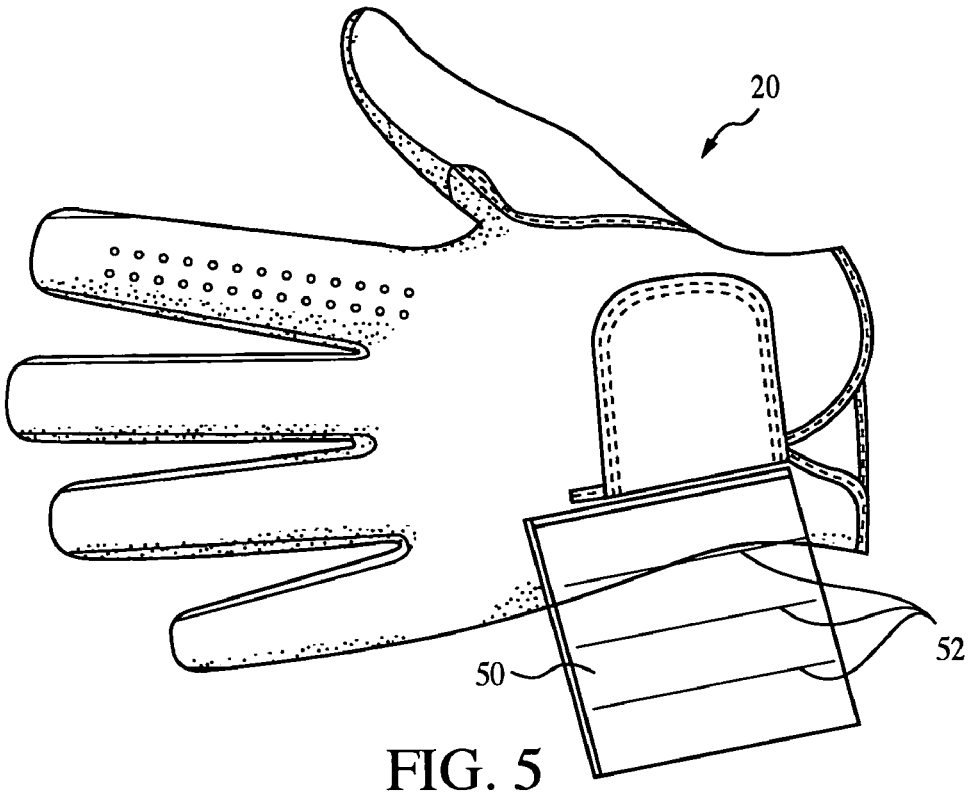
FIG. 5 is a rear view of a sports glove having a container that can be used for storing the glove after use.

FIG. 5 shows another embodiment of a sports glove 20 in which a container 50 for the glove is provided on the glove. The container 50 can be used for storing the glove after use. The container 50 can be a plastic bag that is joined to the glove, and if desired, folded such as along the fold lines 52 shown, to make it smaller in size. In one instance, after the glove 20 is used on a hot day and has perspiration on the same, the glove can be folded and inserted into the plastic bag 50. The bag 50 can be sealed so that after remaining in the bag, the glove remains soft. The bag can be sealed in any suitable manner. In one embodiment, the bag 50 can be provided with a ZIPLOCK® seal.

Figure 6:
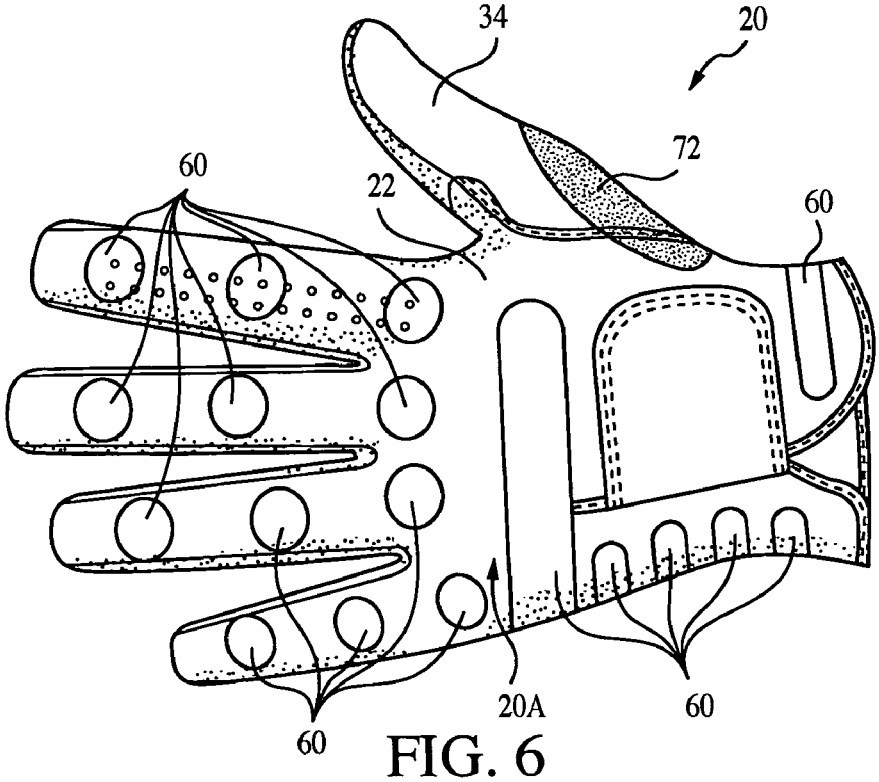
FIG. 6 is a rear view of a sports glove provided with several regions comprising extensible material.

FIG. 6 shows another embodiment of a sports glove 20 in which the glove is provided with several regions 60 comprising extensible material. The regions of extensible material 60 can be located on any suitable portions of the glove, and are not limited in location to those regions shown in FIG. 6. The locations of the regions of extensible material 60 shown in FIG. 6, however, are believed to comprise some of the regions in which the glove 20 becomes baggy after use. Such regions include, but are not limited to, the portions on the back 22 of the glove that correspond to the wearer's knuckles. The glove 20 can be provided with one or more of the regions of extensible material, and is not limited to embodiments having all the regions of extensible material shown in FIG. 6.

The extensible regions 60 can be of any size and shape. The extensible regions 60 can be discrete regions that are not connected to each other, or they can be one or more continuous regions, at least two of which are connected together. Any two or more extensible regions 60 shown in FIG. 6 can be connected to form a single contiguous extensible region. The extensible material can be any suitable type of extensible material. In preferred embodiments, it is desirable for the extensible regions 60 to comprise discrete pieces or patches of extensible material, rather than strips of elastic that are joined to a generally inextensible material, such as leather comprising the body 20A of the glove. In other words, the material comprising the extensible regions 60 can have an inherent extensibility. Such extensible material can comprise any suitable extensible material, including but not limited to SPANDEX® material and LYCRA® material.

It may be desirable for the extensible material to be elastically extensible so that it will tend to relax or contract back to a shortened condition after it has been extended. It may also be desirable for such an elastically extensible material to be joined to the body 20A of the glove in an at least partially extended condition so that the extensible material will tend to retract before, during, and after the glove is worn. The elastically extensible material can retract in any suitable amount, including but not limited to greater than or equal to about 1%, 3%, or 5% of its extended length when the forces associated with putting on the glove and wearing the glove are removed. If the extensible material is attached in an at least partially extended condition, the extensible material may cause the adjacent materials to which it is attached to gather at least slightly, especially when the glove is not worn. This may provide the glove with a closer fit over time.

The extensible material can be extensible in one direction, in more than one direction, or in all directions. If the extensible material is extensible in less than in all directions, the orientation of the direction of extensibility may be in any desired direction for any of the regions of extensibility 60. Such directions of extensibility include, but are not limited to directions generally parallel to a line drawn across the wearer's knuckles, generally perpendicular to such a line, or at any angle thereto. The regions of extensibility 60 may be extensible in the same direction or directions, or in different directions.

The region(s) of extensibility 60 may be provided with any suitable amount(s) of extensibility. The region(s) of extensibility 60 may, for example, be extensible in an amount that falls within a range of from greater than or equal to about 1%, 3%, 5%, etc. to greater than about 100% of its original unextended length under the forces associated with putting on and wearing the glove 20. The region(s) of extensibility 60 may be extensible in any amount that falls within the above range, including but not limited to within a range of from greater than or equal to about 3% to less than or equal to about 97%, or greater than or equal to about 5% to less than or equal to about 95% of its original unextended length under such forces. The region(s) of extensibility 60 may all have the same degree of extensibility (that is, they may be extensible in the same amount under a given force). In other embodiments, glove 20 may have different regions of extensibility that have differing degrees of extensibility under a given force.

The extensible material can be joined to the body 20A of the glove in any suitable manner, including but not limited to sewing. One way of joining material to a body of a glove is shown in U.S. Pat. No. 5,184,353 issued to Goldwitz. The golf glove may be provided with any of the features described in U.S. Pat. No. 5,893,172 issued to Haynes, et al. If desired, the extensible material may also be breathable and/or apertured.

Figure 7:
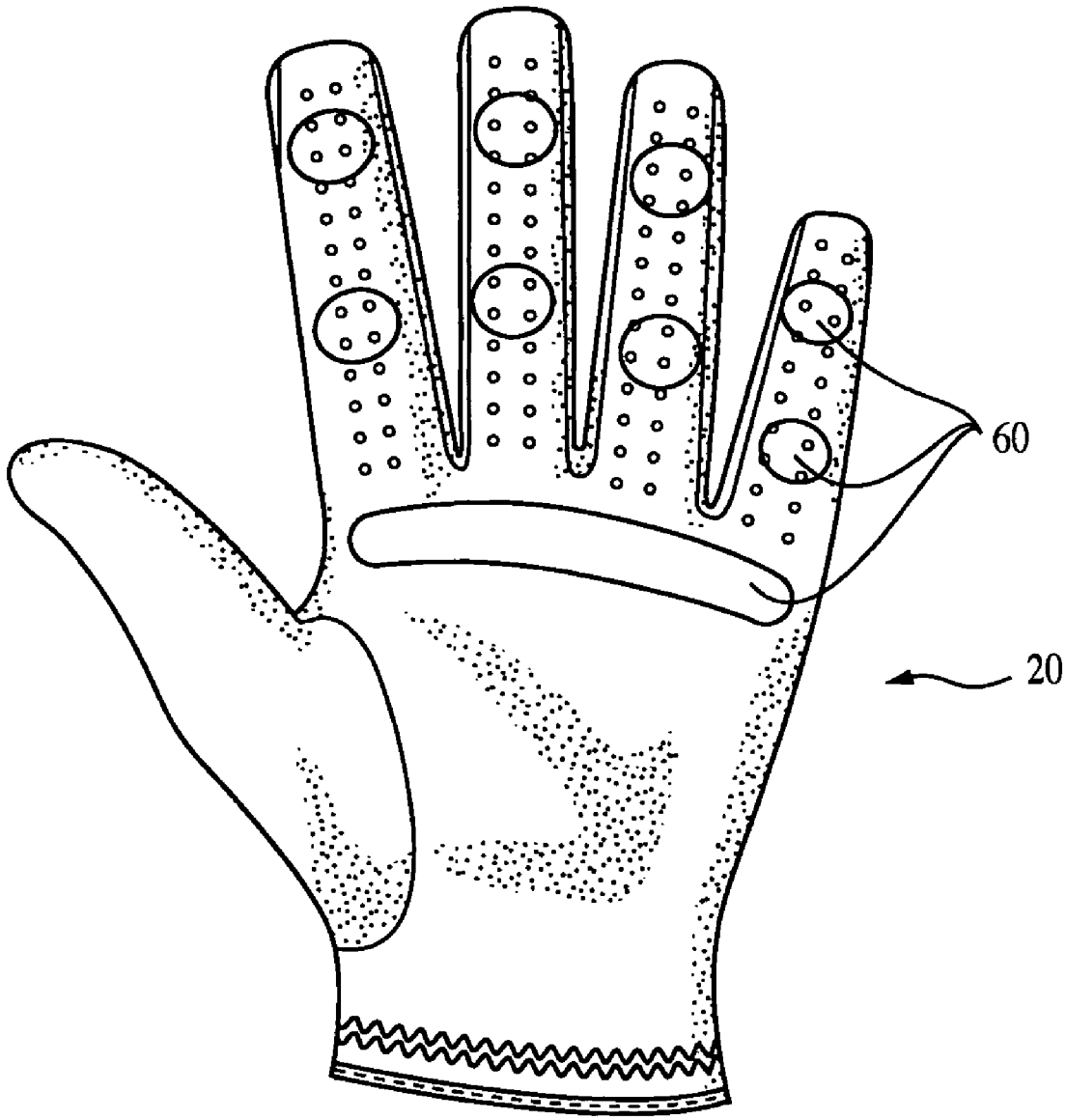
FIG. 7 is a front view of a sports glove provided with several regions of extensibility on the front thereof.

FIG. 7 shows an embodiment of a glove 20 in which regions of extensibility 60 are provided on the front 24 of the glove. As in the case of the other embodiments described herein, the glove shown in this figure is for purposes of illustration. It is not necessary that the glove 20 have all of the features (e.g., regions of extensibility) shown. In some embodiments, it may be desirable to provide extensible regions with greater extensibility on the back portion 22 of the glove, and extensible and/or retractable regions with greater contractability on the front portion 24 of the glove so that the glove 20 will better adapt to the forces exerted on the same when it is worn and the user is clenching their hand to grip an article such as a golf club, baseball bat, etc.

Figure 8:
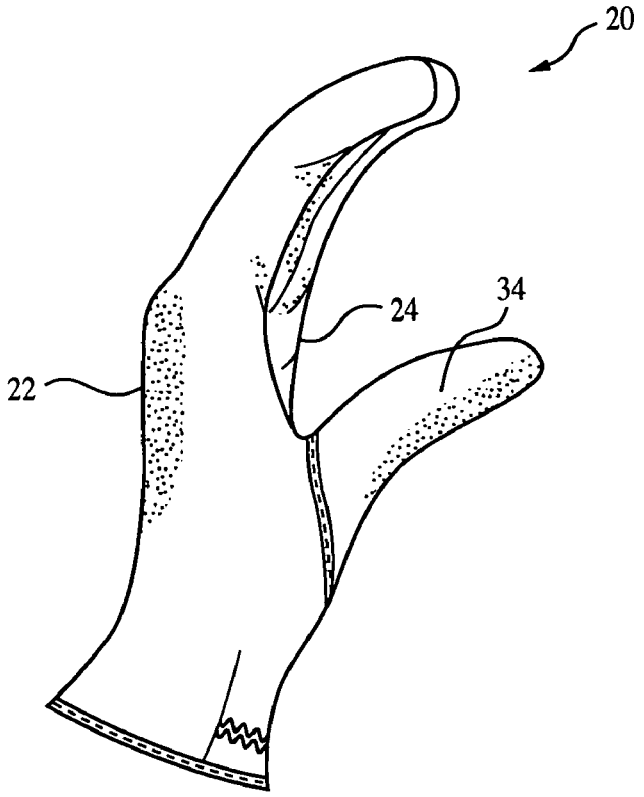
FIG. 8 is a side view of a sports glove which is pre-formed into a curved configuration.

FIG. 8 shows an embodiment in which the glove 20 is provided in a pre-formed curved configuration when viewed from the side. This may allow the glove to better fit the wearer's hand when the glove is in use such as when gripping sporting equipment, such as a golf club or baseball bat. This may also reduce the stresses acting on the sports glove so that the glove has a reduced tendency to become baggy and poor fitting after several uses. The portions of the glove 20 that can be provided in a curved configuration can comprise any suitable portion or portions of the glove, including, but not limited to the back portion 22, the front portion 24, and any of the finger portions. These portions of the glove 20 can be provided with such a curvature in any suitable manner. These portions of the glove can be provided with a curvature by cutting the pieces of material (such as leather and/or synthetic material) that are joined together, such as by sewing, or the like, to form the glove 20 in a manner such that the portions on the front portion of the glove are shortened relative to those that will form the back of the glove. Another way that the glove, or portions thereof, can be provided with curvature is by providing at least one extensible region on the back portion 22 of the glove 20 to make the back portion 22 more extensible than the front portion 24. Another manner of providing the glove 20 with a pre-formed curvature is to provide at least one region on the front portion 24 of the glove that contracts the front portion of the glove 20 relative to the back 22 of the glove. Numerous other methods for providing the glove with such curvature are possible.

Figure 9:
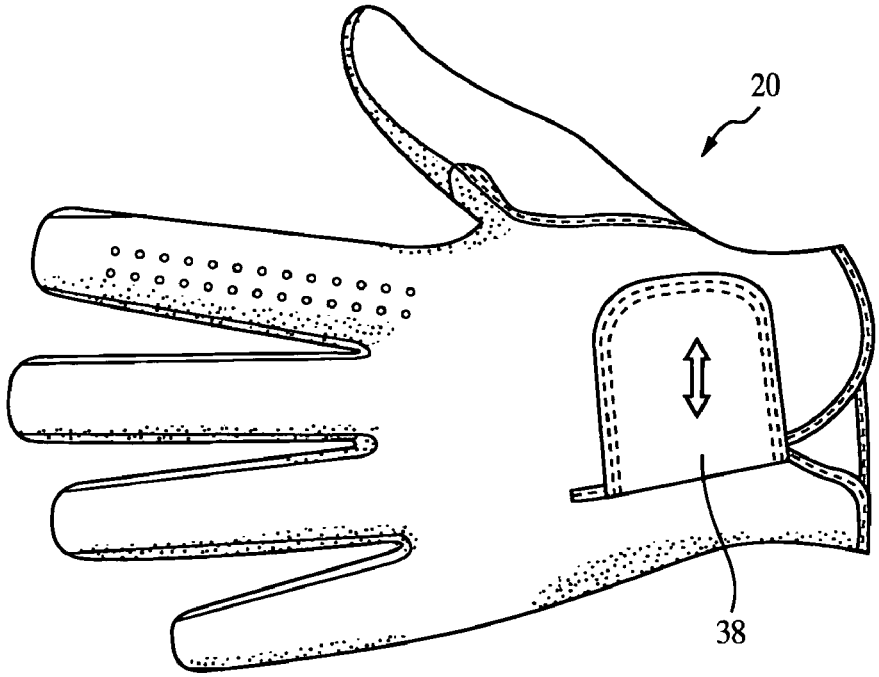
FIG. 9 is a rear view of a sports glove in which the fastener is extensible.

FIG. 9 shows another embodiment of a glove in which the fastener 38 is extensible. The fastener 38 can comprise a hook and loop material, such as VELCRO® fastening material, but the substrate for the hook and loop material can be made of an extensible material. Alternatively, an extensible material can be joined to a portion of one or more of the components of the fastener 38. Such extensible material may include, but is not limited to, SPANDEX® material and LYCRA® material. The fastener 38, or any portion thereof, can be configured so that it is elastically extensible material and can exert a retractive force and/or can retract during wear, or after it is worn.

Figure 10:
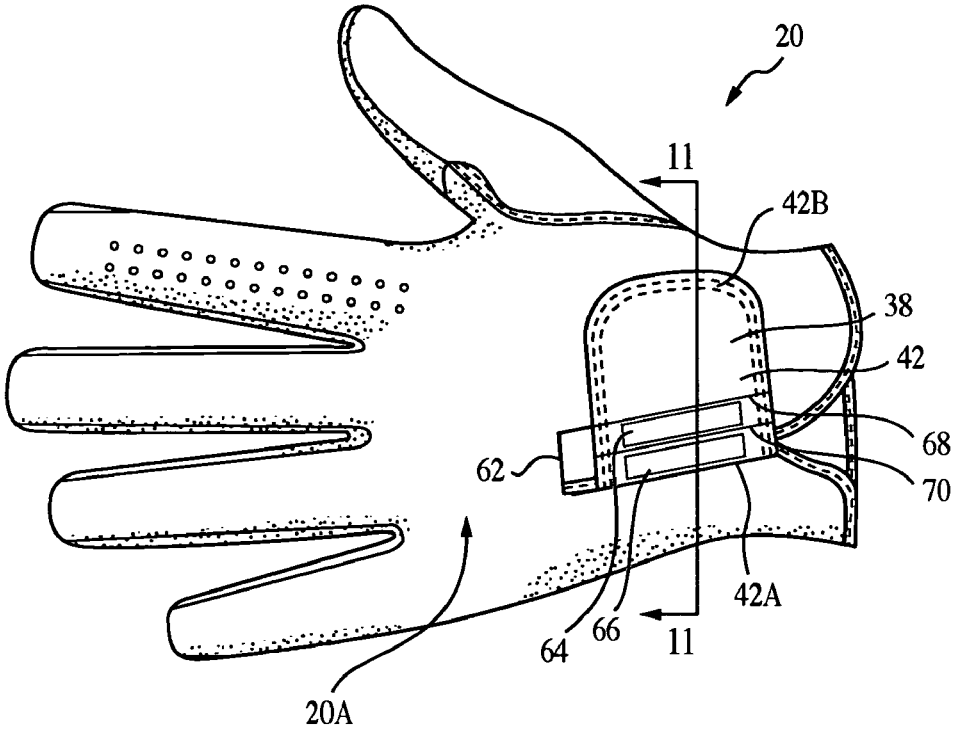
FIG. 10 is a rear view of a sports glove having a fastener that can be adjusted to tighten the closure of the glove.
Figure 11:
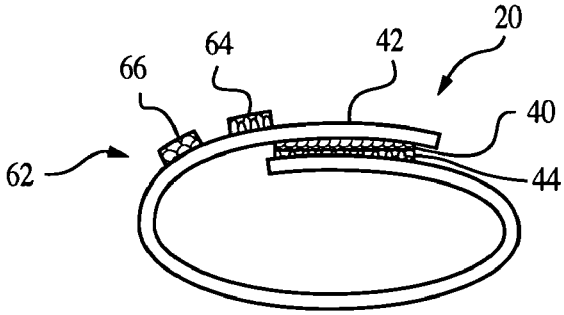
FIG. 11 is a cross-sectional view of the sports glove shown in FIG. 10, taken along line 11—11 of FIG. 10.
Figure 12:
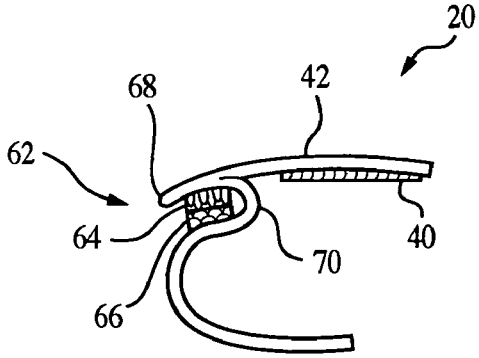
FIG. 12 is a partially cut-away cross-sectional view taken from an angle similar to FIG. 11, only showing the gathering system on the fastener in a folded and secured configuration.

FIGS. 10–12 show another embodiment in which the fastener 38 on the glove 20 can be provided with a structure that can be extended or gathered to provide additional adjustability. The fastening systems on sports gloves, particularly those having a body portion made of leather, will often lose their ability to be adjusted after an initial period of wear. In addition, other portions of the gloves, such as in the areas of the knuckles on the back 22 of the glove 38, will become baggy. Such an embodiment can be used to provide greater adjustability to tighten the glove 20 if it becomes baggy.

In the embodiment shown in FIGS. 10–12, the proximal portion 42A of the extension 42 on the back 22 of the glove 20 can be provided with a gathering system 62. The gathering system 62 can provide the ability to further adjust the glove 20, particularly after the fastener 38 loses its ability to be adjusted. In the embodiment shown, the gathering system 62 comprises a fastening system comprised of complementary fastener components. The complementary fastener components can comprise any suitable fastener components including, but not limited to mechanical fasteners, adhesive fasteners, or other types of fasteners. The complementary fastener components can comprise a combination of male/female fastening components. If mechanical fasteners are used, they can comprise any suitable type of mechanical fasteners including, but not limited to snap fasteners, and hook and loop fasteners.

In the embodiment shown, the gathering system 62 comprises a hook fastener material 64 and a complementary loop fastener material 66. In this embodiment, the hook fastener material 64 and the loop fastener material 66 are located on the back of the extension 42 of the glove 20. The components of the gathering system 62 can be provide with fold lines, or creases, therein, such as fold lines 68 and 70 on the extension 42 of the glove 20. These can be used to assist the folding and gathering of the desired portions of the gathering system 62. In other embodiments, a gathering system 62 can be located on other portions of the glove, or components thereof. FIG. 11 shows the gathering system 62 in a non-gathered configuration. FIG. 12 shows the gathering system 62 on the fastener 38 in a folded and secured configuration. As shown in FIG. 12, the extension or flap 42 of the fastener 38 is folded back onto itself to form a pleated structure that shortens the flap 42 in order to allow additional adjustment, especially to allow the fastener 38 to be further tightened.

The fastening components of the gathering system 62 can be provided with any suitable characteristics. In some embodiments, it may be desirable for the fastening components of the gathering system 62 to form a stronger bond with each other than the components of the primary fastener 38 on the glove so that the gathering system 62 will remain in a gathered or retracted configuration when the primary fastener 38 is adjusted.

Numerous other types of modifications can be made to the fastener 38 to allow the fastener 38 to be adjusted in a similar manner to the embodiment shown in FIGS. 10–12. For example, in other embodiments, the body of the glove and any portion of the extension 42, including the proximal portion 42A (and/or the distal portion 42B) of the extension 42 on the back 22 of the glove 20 can be provided with an adjustment feature of the same type that is found on adjustable baseball caps. In other embodiments, any alternative type of adjustment system can be used.

Figure 13:
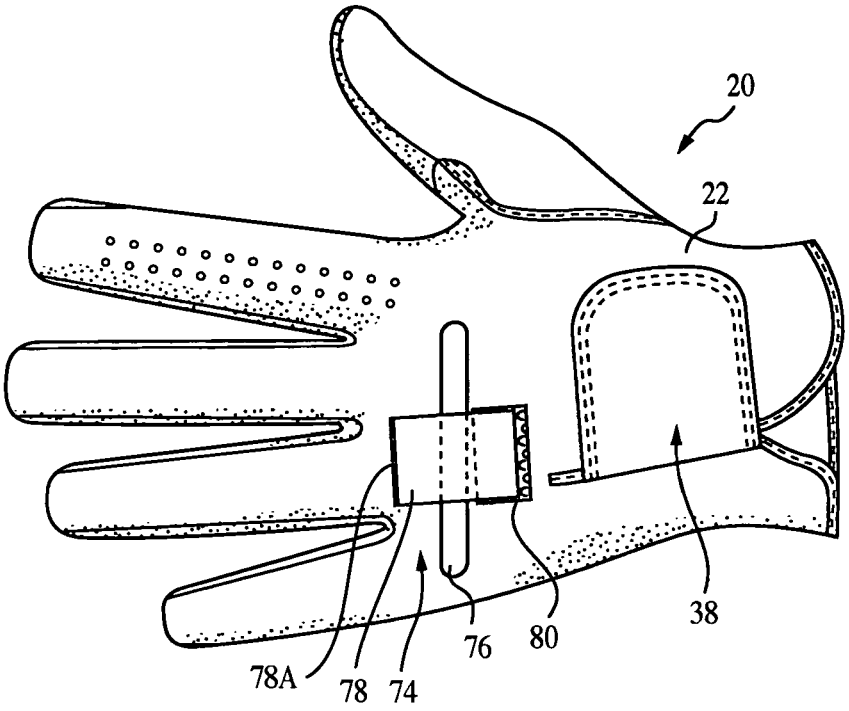
FIG. 13 is a rear view of a sports glove having an additional adjustment mechanism.

FIG. 13 shows an embodiment in which the glove 20 is provided with a feature that allows the glove 20 to be adjusted in other regions and/or directions. Sports gloves are often only provided with a fastener 38 that forms an adjustable closure on the portion of the glove that is worn adjacent to the back of the wearer's hand. Such closures typically only provide adjustability in a direction that runs generally perpendicular to the fingers of the glove. In the embodiment shown in FIG. 13, the sports glove 20 is provided with an additional (or alternative) adjustment system 74 that provides the ability to adjust the fit of the glove 20 in a different direction. In this particular embodiment, the additional adjustment system provides the glove 20 with the ability to adjust the fit of the glove in a direction that is oriented generally in the same direction in which the fingers extend (such as parallel to the fingers of the glove).

The additional adjustment system 74 can be provided in any suitable form. It should be understood that although such an adjustment system may be described as the "additional adjustment system", in some embodiments, such an adjustment system may comprise an alternative adjustment system to the primary adjustment system, fastener 38. Thus, instead of merely being in addition to the primary adjustment system, it may be configured to serve as the primary adjustment system. This additional adjustment system may be configured so that it provides the ability to adjust any portion of the glove in any direction, and at any angle relative to the finger portions of the glove 20 from 0° to 360°. In some cases, it may be desirable for the additional adjustment system to be configured and located so that it is capable of adjusting the glove in a direction that is different from that of the primary adjustment system. If desired, the additional adjustment system 74 can span regions of extensibility 60 to adjust the same.

In some embodiments, the additional adjustment system can be constructed similarly to the primary fastening system 38. For example, in one non-limiting embodiment, the additional adjustment system may be comprised of complementary fastening components. FIG. 13 shows that in one version of such an embodiment, the additional adjustment system 74 can comprise an optional vent 76 which can function similarly to the V-shaped notch used in the primary fastening system 38. The additional adjustment system 74 can comprise an adjustment strap 78 to adjust the glove in the direction of the fingers of the glove. The adjustment strap 78 may have one component of a complementary fastening system located on its underside. The component on the underside of the adjustment strap 78 may releasably engage with a complementary fastening component 80 located on the opposite side of the vent 76 from the proximal or attached end 78A of the adjustment strap 78. This complementary fastening component 80 serves as a landing zone for the component on the underside of the adjustment strap 78.

Figure 14:
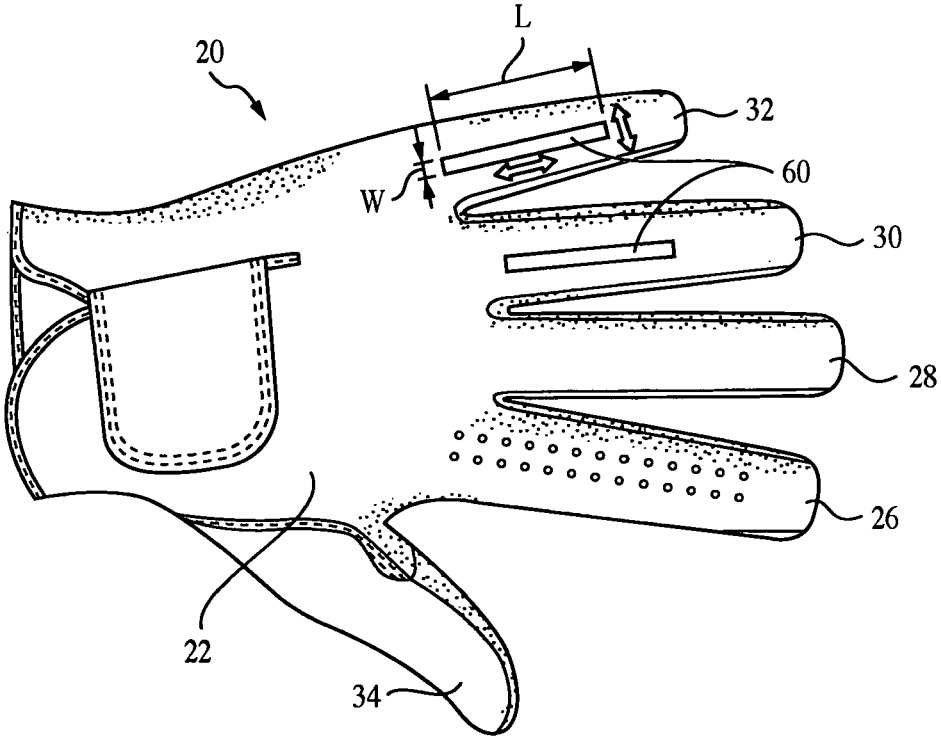
FIG. 14 is a rear view of a sports glove that has at least one extensible region with an alternative configuration.

FIG. 14 shows a sports glove 20 that has at least one extensible region 60 with an alternative configuration. In the embodiment shown in FIG. 14, the sports glove 20 can be provided with one or more extensible regions on the back, sides, front of the fingers, or any combinations thereof. Two extensible regions 60 are shown for simplicity. It should be understood that additional extensible regions can be provided at any suitable location on any of the fingers of the glove. The extensible regions 60 can be extensible in any suitable direction(s), including, but not limited to: in the direction of either of the arrows shown; in the directions or both sets of arrows; or in omni-directions. The extensible regions 60 can have a length, L, that is longer than the distance between the portions of the fingers of the glove that will be worn adjacent to the wearer's knuckles. The extensible regions 60 can have any suitable dimensions. In some non-limiting embodiments, for example, the length, L, of the extensible regions 60 can be greater than the width, W, of the extensible regions. In some cases, the length, L, of these extensible regions can be any number of times greater than the width, W, thereof, including, but not limited to: 1.1; 1.2; 1.3; . . . , etc. The extensible regions 60 can be formed in any of the manners described for the other embodiments discussed herein, including but not limited to by stretching and attaching extensible material to the body of the glove. The extensible regions 60 can be used to reduce or eliminate bagginess on the fingers and/or thumb portion of the glove, or for other purposes.

Figure 15:
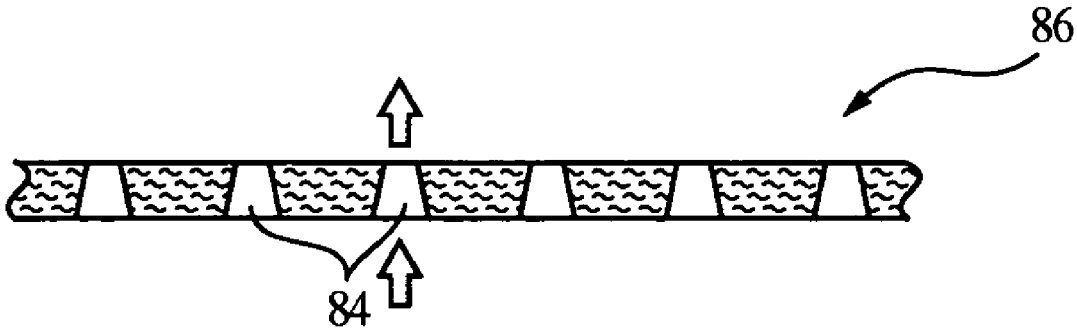
FIG. 15 is a side view of a fragmented portion of a sports glove that has apertures have a shape that is one-directional (e.g., funnel-shaped).
Figure 16:
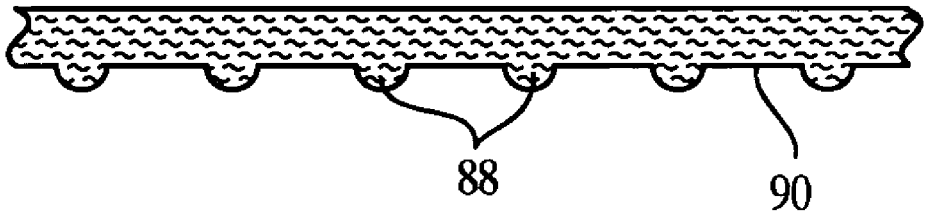
FIG. 16 is a side view of a fragmented portion of a sports glove that is provided with protuberances or projections on the inner surface of the glove.

In any of the embodiments described herein, any of the regions the glove that are extensible can also be breathable. It may also be desirable to make other regions of the glove breathable, even if they are not extensible. For example, as shown in FIG. 6, it may be desirable to provide the thumb portion 34 of the glove 20 with breathability, especially in the area 72 where the other hand is placed on top thereof in the case of a golf glove. In any of the embodiments in which the glove is provided with apertures 84, the surrounding portions of the portion 86 of the glove may be configured such as is shown in FIG. 15 so that the apertures 84 have a shape that is one-directional (e.g., funnel-shaped) to transport moisture away from the wearer's skin. This may reduce the chance that the moisture will come back through the glove. In these or other embodiments, the glove may be provided with one or more vents in key places, or other places. As shown in FIG. 16, the glove 20 may be provided with a substance, or protuberances or projections 88 on at least a portion 90 of the inner surface of the glove 20 to space portions of the wearer's hand away from the glove material. This latter embodiment can be used to reduce perspiration, if desired.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that this is by way of illustration and not by way of limitation and the scope of the invention is defined solely by the appended claims which should be construed as broadly as the prior art will permit.

What is claimed is:

1. A sports glove comprising:

a body portion comprising a front portion that fits adjacent to a wearer's palm, a back portion that fits adjacent to the back of a wearer's hand, a portion of said front and back portions being joined to each other, and four finger portions and a thumb portion projecting from said front and back portions; and a fastening system comprising:

a hook material having two sides and comprising a plurality of hooks extending outwardly on one side of said hook material; and a complementary loop material having two sides and comprising a plurality of loops extending outwardly on one side of said loop material, wherein said hook material is joined to a portion of said body portion and said loop material is joined to another portion of said body portion, wherein said hook material and said loop material comprise components of said fastening system which can be at least partially overlapped to close said fastening system, and at least one of said hook material and said loop material has at least three apertures therein, wherein at least some of said apertures are also formed in at least a portion of said body portion and are substantially coterminous with at least some of said apertures in at least one of said hook material and said loop material so that at least a portion of said fastening system is breathable, wherein said components of said fastening system have a transverse direction that is oriented perpendicular to the finger portions of the glove, and said at least three apertures are disposed in a spaced apart arrangement relative to each other in the transverse direction.

2. The sports glove of claim 1 wherein at least some of said apertures have a configuration that is longer in one direction than in another direction.

3. The sports glove of claim 2 wherein the components of the fastening system have a transverse dimension that is oriented in the transverse direction, and at least one of said apertures has a length that is less than or equal to about one-half the transverse dimension of the component of said fastening system in which said at least one aperture is formed.

4. The sports glove of claim 3 wherein at least one of said apertures has a length that is less than or equal to about one-fourth the transverse dimension of the component of said fastening system in which said at least one aperture is formed.

5. The sports glove of claim 2 wherein at least some of said apertures are longer in the transverse direction than in the longitudinal direction.

6. The sports glove of claim 1 wherein at least some of said apertures are longer when measured in one direction than when measured in another direction, so that the sides of said apertures are longer than the ends of said apertures, and the ends of said apertures are rounded.

7. The sports glove of claim 6 wherein said at least some of said apertures are oblong.

8. The sports glove of claim 1 wherein at least some of said apertures are funnel-shaped.

9. A sports glove comprising:

a body portion; and a fastening system comprising:

a hook material comprising a hook material substrate and a plurality of hooks extending from the hook material substrate; and a complementary loop material comprising a loop material substrate and a plurality of loops extending from said loon material substrate, wherein said hook material is joined to a portion of said body portion and said loop material is joined to another portion of said body portion, and wherein the combination of at least a portion of at least one of said substrates of said hook material and said loop material and the portion of said body portion to which at least one of said hook material and said loop material is joined is breathable, wherein at least a portion of said fastening system has apertures therein and at least some of said apertures are arranged in spaced apart rows of apertures wherein the apertures in at least some of said rows are staggered relative to the apertures in another row of apertures.

10. The sports glove of claim 9 said body portion comprises a front portion that fits adjacent to a wearer's palm, a back portion that fits adjacent to the back of a wearer's hand, and four finger portions and a thumb portion projecting from said front and back portions, wherein said sports glove has a longitudinal direction that is oriented parallel to the finger portions of the glove and a transverse direction that is oriented perpendicular to the finger portions, and at least some of said apertures have a shape that is longer in one direction than in another direction.

11. The sports glove of claim 10 wherein said at least some of said apertures are longer in the transverse direction than in the longitudinal direction.

12. The sports glove of claim 10 wherein said apertures have sides and ends, and the sides of said at least some of said apertures are longer than the ends of said apertures, and the ends of said apertures are rounded.

13. The sports glove of claim 12 wherein said at least some of said apertures are oblong.

14. A sports glove comprising:

a body portion; and a fastening system comprising:

a hook material comprising a hook material substrate and a plurality of hooks extending from the hook material substrate; and a complementary loon material having two sides and comprising a substrate and a plurality of loops extending from said loop material substrate, wherein said hook material is joined to a portion of said body portion and said loop material is joined to another portion of said body portion, and wherein the combination of at least a portion of at least one of said substrates of said hook material and said loop material and the portion of said body portion to which at least one of said hook material and said loop material is joined is breathable, wherein at least a portion of said fastening system has apertures therein and wherein at least some of said apertures are longer when measured in one direction than when measured in another direction, so that the sides of said apertures are longer than the ends of said apertures, and the ends of said apertures are rounded.

15. The sports glove of claim 14 wherein said body portion comprises a front portion that fits adjacent to a wearer's palm, a back portion that fits adjacent to the back of a wearer's hand, and four finger portions and a thumb portion projecting from said front and back portions, wherein said sports glove has a longitudinal direction that is oriented parallel to the finger portions of the glove and a transverse direction that is oriented perpendicular to the finger portions, and said at least some of said apertures are longer in the transverse direction than in the longitudinal direction.

16. The sports glove of claim 15 wherein said at least some of said apertures are oblong.

* * * * *

UNITED STATES PATENT AND TRADEMARK OFFICE

CERTIFICATE OF CORRECTION

PATENT NO. : 6,964,063 B2
DATED : November 15, 2005
INVENTOR(S) : Jeffrey V. Bamber It is certified that error appears in the above-identified patent and that said Letters Patent is hereby corrected as shown below:

Column 10,
Lines 21 and 61, replace "loon", with -- loop --.

Signed and Sealed this

Twenty-first Day of March, 2006

JON W. DUDAS
*Director of the United States Patent and Trademark Office*